US006205298B1

(12) United States Patent
Yamamoto

(10) Patent No.: US 6,205,298 B1
(45) Date of Patent: Mar. 20, 2001

(54) IMAGE FORMING APPARATUS, AND RECYCLE PROCESSING APPARATUS FOR RECYCLING IMAGE FORMING UNIT

(75) Inventor: Shuuhei Yamamoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/179,194

(22) Filed: Oct. 27, 1998

(30) Foreign Application Priority Data

Oct. 28, 1997 (JP) ..... 9-295220

(51) Int. Cl.[7] ..... G03G 15/00
(52) U.S. Cl. ..... 399/25; 399/26
(58) Field of Search ..... 399/9, 10, 24, 399/25, 26, 42, 43, 111

(56) References Cited

U.S. PATENT DOCUMENTS

| | | | | |
|---|---|---|---|---|
| Re. 35,751 | * | 3/1998 | Midgley | 399/25 |
| 4,851,875 | * | 7/1989 | Tanimoto | 399/24 |
| 4,855,754 | * | 8/1989 | Tanaka et al. | 399/26 X |
| 5,272,503 | * | 12/1993 | Lesueur et al. | 399/25 |
| 5,572,292 | * | 11/1996 | Chatani et al. | 399/25 |
| 5,596,388 | * | 1/1997 | Ohkubo et al. | 399/111 |
| 5,758,224 | * | 5/1998 | Binder et al. | 399/25 |

FOREIGN PATENT DOCUMENTS

| | | |
|---|---|---|
| 0 532 308 | 3/1993 | (EP) . |
| 5-249830 | 9/1993 | (JP) . |
| 7-66885 | 3/1995 | (JP) . |
| 7-43549 B2 | 5/1995 | (JP) . |
| 8-248861 | 9/1996 | (JP) . |

OTHER PUBLICATIONS

Patent Abstract of Japan, vol. 096, No. 010, Oct. 31, 1996 and JP 08 160680 A (Canon Inc.), Jun. 21, 1996.

Patent Abstract of Japan, vol. 011, No. 276 (P–613), Sep. 8, 1987 and JP 62 075667 A (Konishiroku Photo Ind. Co. Ltd.), Apr. 7, 1987.

Patent Abstract of Japan, vol. 016, No. 006 (P–1296), Jan. 10, 1992 and JP 03 230172 A (Seiko Epson Corp.), Oct. 14, 1991.

Patent Abstract of Japan, vol. 007, No. 249 (P–234), Nov. 5, 1983 and JP 58 132758 A (Canon KK), Aug. 8, 1983.

* cited by examiner

*Primary Examiner*—William Royer
*Assistant Examiner*—Hoan Tran
(74) *Attorney, Agent, or Firm*—Nixon & Vanderhye P.C.

(57) ABSTRACT

An excellent image forming state is secured constantly regardless of the history of an image forming unit installed. When a new drum cartridge is installed in a copying machine during a standby pending operation of a copy switch on a control panel, CPU reads the number of rotations of a photoreceptor drum from a memory of the drum cartridge, and updates a count of a counter C with the number of rotations read. When the copy switch is operated, CPU derives a grid voltage corresponding to the count of counter C from a relationship between the number of rotations of photoreceptor drum and the grid voltage of the electrostatic charger pre-stored in ROM, executes an image forming process by setting the grid voltage derived to a high-voltage source, and adds the number of rotations of photoreceptor drum made in the current image forming process to the count of counter C.

7 Claims, 9 Drawing Sheets

FIG. 6
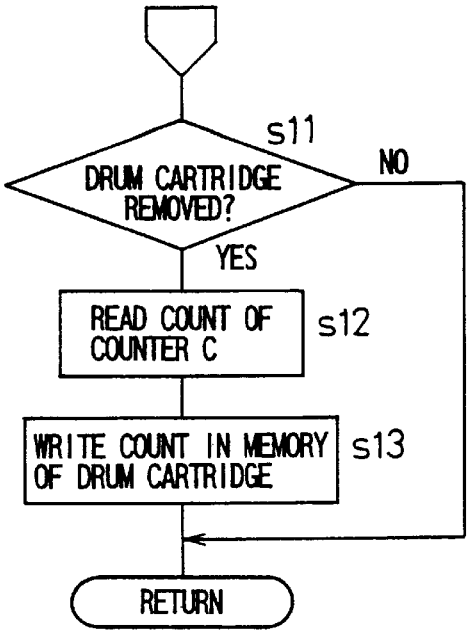
FIG. 7A
DATE OF INSPECTION DEC. 14, 1996
PRODUCT CODE: A3ZT50DRG
COPY COUNT: 9,800
NOTE: NONE
DATE OF PREVIOUS CHANGE: JUN. 20, 1995
PREVIOUS COUNT: 5,500
ITEM CHANGED: DRUM
PREVIOUS CONDITION: NORMAL
DATE OF MANUFACTURE: JAN. 15, 1994
FIG. 7B
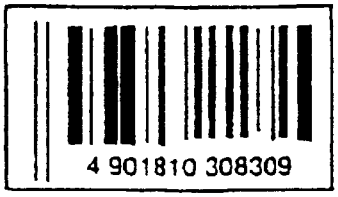

FIG. 11A

DATE OF INSPECTION DEC. 14, 1996

PRODUCT CODE: A3ZT50DRG
COPY COUNT: 9,800
NOTE: NONE
DATE OF PREVIOUS CHANGE: JUN. 20, 1995
PREVIOUS COUNT: 5,500
ITEM CHANGED: DRUM
PREVIOUS CONDITION: NORMAL

WORK PROCEDURE

| | CHECK |
|---|---|
| DRUM CHANGE | ☐ |
| TONER SEAL CHANGE | ☐ |
| MAIN CHARGER CLEANING | ☐ |
| CLEANING OF PARTS | ☐ |

DATE OF MANUFACTURE: AUG. 15, 1992

FIG. 11B

DATE OF INSPECTION DEC. 14, 1996

PRODUCT CODE: A3ZT50DRE
COPY COUNT: 5,000
NOTE: PRESENT
DATE OF PREVIOUS CHANGE:
PREVIOUS COUNT:
ITEM CHANGED:
PREVIOUS CONDITION:

WORK PROCEDURE

| | CHECK |
|---|---|
| TONER SEAL CHANGE | ☐ |
| CLEANING OF PARTS | ☐ |

DATE OF MANUFACTURE: JAN. 8, 1995

IMAGE FORMING APPARATUS, AND RECYCLE PROCESSING APPARATUS FOR RECYCLING IMAGE FORMING UNIT

BACKGROUND OF THE INVENTION

1. Field of the Invention

The present invention relates to a recycling system for image forming apparatus such as copying machines or printers for recycling an image forming unit removably mounted in the image forming apparatus. More particularly, the invention relates to an image forming apparatus having a recyclable image forming unit removably mounted therein, and to a recycle processing apparatus for use in recycling the image forming unit.

2. Description of the Related Art

Recycling systems for image forming apparatus have been proposed heretofore to meet the demands for environmental protection and resource saving. Such an image forming apparatus includes image forming units such as a developing unit, a fixing unit and a processing unit removably mounted therein. When any of these units fails or comes to the end of its service life, the unit is removed from the image forming apparatus, renovated and sold as a recycled product.

Japanese Unexamined Patent Publication JP-A 7-66885 (1995), for example, discloses a construction for promoting recycling of image forming units. In this construction, data management is effected in relation to use periods of the respective image forming units to enable an easy determination of a time for recycling each image forming unit.

Japanese Unexamined Patent Publication JP-A 5-249830 (1993) discloses a construction including a display provided in the exterior of a toner cartridge for displaying the number of recycle times which is incremented each time the cartridge is installed in an image forming apparatus, thereby facilitating a determination to be made as to whether the cartridge may be recycled again or not.

In image forming apparatus, different control conditions such as developing bias and charge voltage during image formation take different values for maintaining an excellent image formation according to the states of image forming units such as a developing unit, a fixing unit and a processing unit. None of the conventional image forming apparatus set a control condition during image formation, based on historical data such as the numbers of recycled times of the image forming units. The control condition during image formation may not be suited to the states of the image forming units mounted in the image forming apparatus, which results in a deterioration in the quality of images formed.

For example, a processing unit including a photoreceptor not having reached the end of its service life may be recycled without changing the receptor. In the image forming apparatus having, mounted therein, the processing unit having undergone this recycle process, the control condition such as developing bias or charge voltage for achieving an excellent image formation takes a value different from an initial value, depending on the past use frequency of the photoreceptor. It is therefore necessary to vary the control condition during image formation, as appropriate, according to the use frequency of the photoreceptor included in the processing unit installed. However, none of the conventional image forming apparatus set a control condition during image formation according to the use frequency of the photoreceptor included in the processing unit installed.

When recycling each image forming unit, different processes are required according to its history such as use state of the image forming unit. None of the conventional image forming apparatus and the recycle processing apparatus are devised to classify the image forming units easily according to history. Thus, the recycle process of each image forming unit cannot be easily carried out according to its history, but consumes a long time.

Where, for example, an image forming unit includes a damaged component, the damaged component must be changed during a recycle process. None of the conventional image forming apparatus and the recycle processing apparatus are devised to notify the operator beforehand of the presence of the component needing replacement in the image forming unit to be recycled.

SUMMARY OF THE INVENTION

An object of the present invention is to provide an image forming apparatus for constantly assuring an excellent image formation regardless of the history of an image forming unit installed, which is achieved by setting a control condition during image formation based on historical data relating to recycling of the image forming unit.

Another object of the invention is to provide an image forming apparatus and a recycle processing apparatus for enabling the operator to determine beforehand a history needed for determination of a recycle process to be carried out, thereby to facilitate the recycle process based on the history of each image forming unit.

The invention provides an image forming apparatus having a recyclable image forming unit removably mounted therein, including:

- a historical data reader for reading historical data stored in the image forming unit; and
- a controller for setting a control condition for image formation based on the historical data read by the historical data reader.

According to the invention, a control condition for image formation is set based on the historical data read from the image forming unit installed. The control condition such as developing bias or charge voltage is set according to the history of the image forming unit installed. Thus, an excellent image forming state may be maintained regardless of the history of the image forming unit installed.

In the invention, the historical data to be stored in the image forming unit may be outputted when the image forming unit is removed from the image forming apparatus for recycling of the image forming unit.

According to the invention, the image forming apparatus, during changing of the image forming unit, outputs the historical data of the image forming unit removed therefrom to undergo a recycle process. It is thus possible to output accurately the historical data such as the number of times the image forming unit has been used during its service period in the image forming apparatus. Particulars of a recycle process to be carried out for each image forming unit may be determined accurately based on the historical data.

In the invention, the image forming apparatus may further include an input device for accepting an input of the historical data to be stored in the image forming unit.

According to the invention, the historical data inputted from the input unit of the image forming apparatus is outputted as the historical data of the image forming unit mounted in the image forming apparatus. The image forming apparatus may output, for example, the historical data of the image forming unit including particulars of a maintenance operation inputted by a serviceman through the input device during maintenance. The particulars of the recycle process to be carried out for each image forming unit may be determined accurately based on the historical data including particulars of the maintenance operation.

The invention provides also a recycle processing apparatus for recycling an image forming unit, including:

- a mount for receiving the image forming unit to be recycled;
- a historical data reader for reading historical data stored in the image forming unit received by the mount; and
- an output device for outputting, as visible information, the historical data read by the historical data reader.

According to the invention, the historical data read from the image forming unit to be recycled is outputted as visible information. Based on the visible information outputted, each image forming unit may be classified accurately so that a necessary recycle process be carried out according to the historical data.

In the invention, the output device may output particulars of the recycle process according to the historical data as visible information.

According to the invention, particulars of the recycle process according to the historical data stored in the image forming unit to be recycled are outputted as visible information. Based on the visible information outputted, the recycle process may be executed accurately for each image forming unit according to the historical data.

BRIEF DESCRIPTION OF THE DRAWINGS

Other and further objects, features, and advantages of the invention will be more explicit from the following detailed description taken with reference to the drawings wherein:

FIG. 6 is a flow chart showing part of a processing sequence of the controller of the copying machine in one embodiment of the invention;

FIGS. 7A and 7B are views showing seals which are printed and outputted by the copying machine;

FIGS. 11A and 11B are views showing other examples of seals which are printed and outputted by the copying machine.

DETAILED DESCRIPTION OF THE PREFERRED EMBODIMENTS

An embodiment of the present invention will be described hereinafter, in which a copying machine is taken as an example of image forming apparatus, and a drum cartridge as an example of image forming units. The present invention is equally applicable to other image forming apparatus such as a laser printer, and other image forming units such as a fixing unit.

Figure 1:
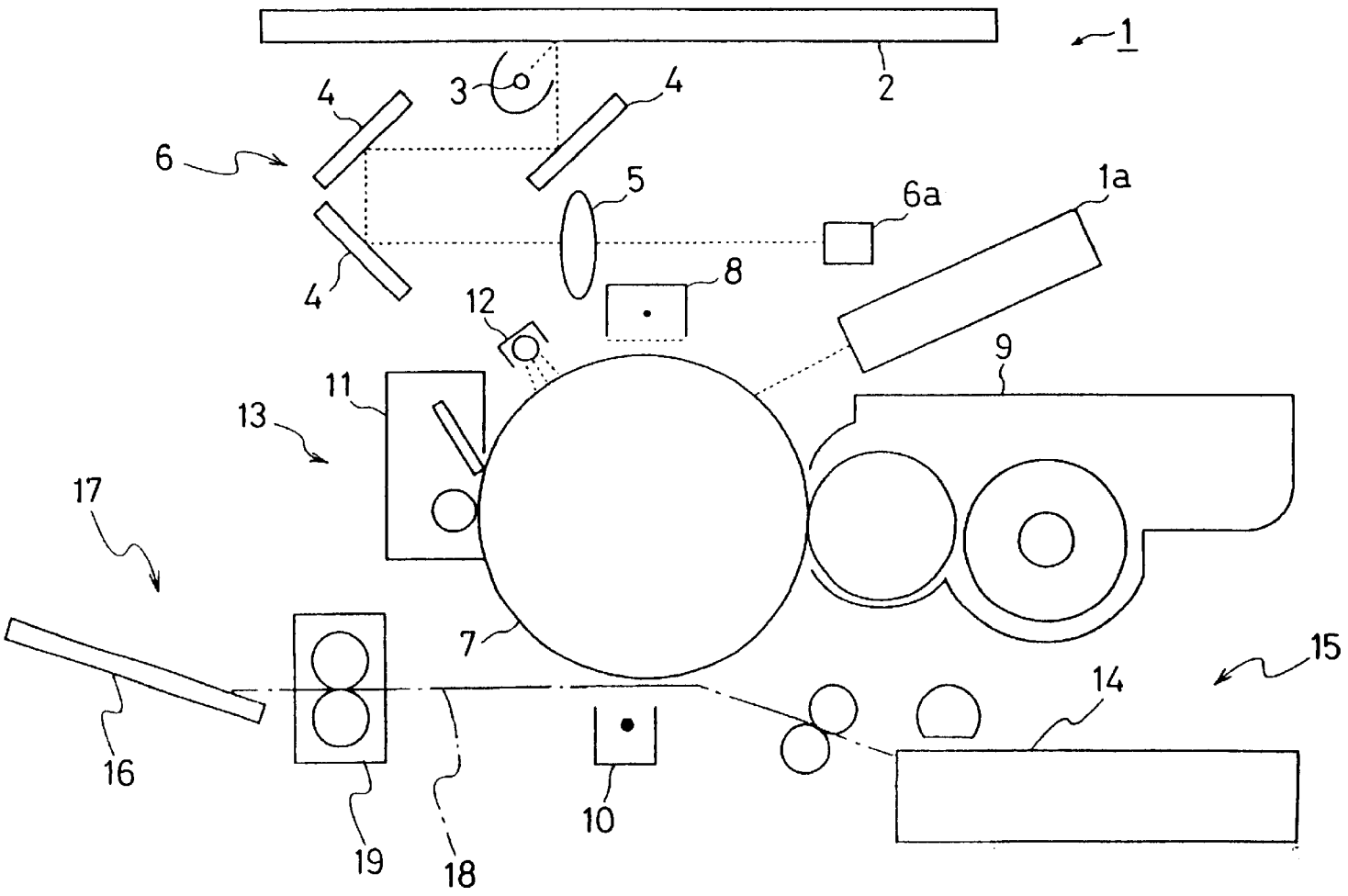
FIG. 1 is a view showing a copying machine which is an image forming apparatus embodying the present invention.

FIG. 1 shows the copying machine which is an image forming apparatus according to the present invention. The copying machine 1 includes an original table 2 disposed on an upper surface thereof, an image reading device 6 disposed below the original table 2 and having a light source 3, mirrors 4, a lens 5 and a CCD 6*a*, a photoreceptor drum 7 rotatably supported in a central position inside the machine 1, and a processing unit 13 having an electrostatic charger 8, a developing device 9, a transfer charger 10, a cleaner 11 and an eraser lamp 12 arranged around the photoreceptor drum 7.

The copying machine 1 further includes an image writing device 1*a* mounted therein and having an image processor and a laser unit. The copying machine 1 also includes a paper feeder 15 with a paper feed cassette 14 attached to one side thereof, and a paper discharger 17 with a paper output tray 16 attached to the other side. Inside the copying machine 1 is a paper transport path 18 extending from the paper feeder 15 to the paper discharger 17 through the processing unit 13. A fixing device 19 is disposed between the processing unit 13 and paper discharger 17.

In an operation of the above copying machine 1 for copying an original image, the light source 3 and mirrors 4 of the image reading device 6 are moved parallel to an original placed on the original table 2. The light of light source 3 reflected from an image-bearing surface of the original is received by the CCD 6*a* by way of the mirrors 4 and lens 5. A reception signal of CCD 6*a* is inputted to the image processor of image writing device 1*a*, and thereafter supplied as image data to the laser unit. The laser unit of image writing device 1*a* emits laser beams corresponding to the image data to the surface of photoreceptor drum 7.

Prior to exposure to the laser beams, the surface of photoreceptor drum 7 is given a uniform charge of single polarity by a corona discharge from the electrostatic charger 8. When the surface of photoreceptor drum 7 is exposed to the laser beams, an electrostatic latent image is formed thereon by photoconductive action. The surface of photoreceptor drum 7 with the electrostatic latent image formed thereon is moved to a position opposed to the developing device 9, where the electrostatic latent image is turned into a visible developer image with a developer supplied by the developing device 9.

Synchronously with the rotation of photoreceptor drum 7, paper supplied from the paper feeder 15 is transported along the paper transport path 18 to a position between the photoreceptor drum 7 and transfer charger 10. Then, the developer image on the surface of photoreceptor drum 7 is transferred to the surface of the paper by a corona discharge from the transfer charger 10. The paper with the developer image transferred thereto is heated and pressurized by the fixing device 19, whereby the developer image is melted and fixed to the surface of the paper. The paper having exited the fixing device 19 is discharged to the paper output tray 16 of paper discharger 17.

The surface of photoreceptor drum 7 having passed through the position opposed to the transfer charger 10 has residual parts of the developer removed by the cleaner 11, and residual charge eliminated by the eraser lamp 12, and is thereafter moved to the position opposed to the electrostatic charger 8. Thus, the surface of photoreceptor drum 7 repeatedly undergoes the processes of charging of single polarity, forming an electrostatic latent image through exposure, visualizing the image by developer supply, transferring the developer, removing residual developer and eliminating residual charge.

Figure 2:
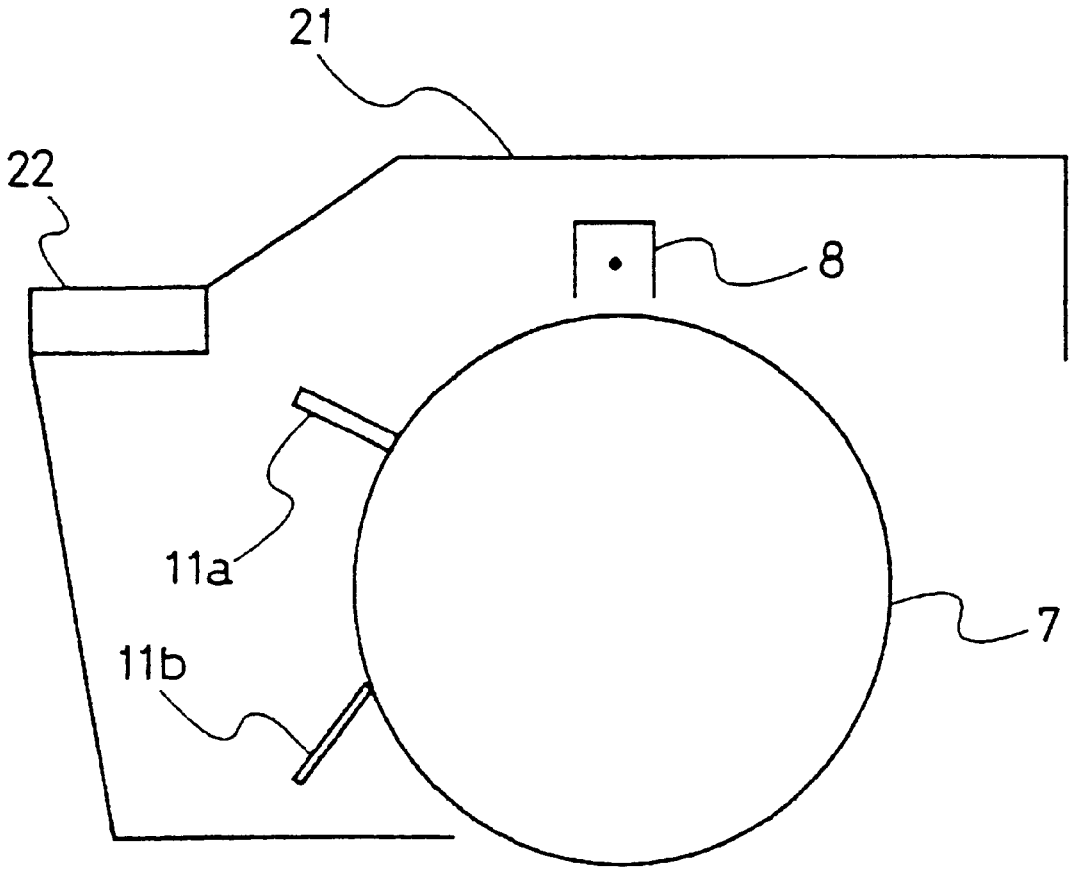
FIG. 2 is a view showing a drum cartridge removably mounted in the copying machine.

As shown in FIG. 2, the photoreceptor drum 7, electrostatic charger 8, and a blade 1*a* and a seal 11*b* of cleaner 11 are integrated into a drum cartridge 21 acting as an image forming unit of the present invention removably mounted in the copying machine 1. A coating on the surface of photoreceptor drum 7 wears with rotation of photoreceptor drum 7 over time during image formation, to lower the quality of images formed. It is therefore necessary to perform a recoating process when the photoreceptor drum 7 has rotated a predetermined number of times at the end of its life. In addition, the surface of photoreceptor drum 7 or the seal 11*b* may be damaged by paper jamming or other mishaps. It is then necessary to replace a damaged component with a new product. When the life of photoreceptor drum 7 has come to an end or a damaged component is to be changed, the drum cartridge 21 is removed from the copying machine 1 in order to perform a recycle process.

In a recycle process of drum cartridge 21 having come to the end of its life, the surface of photoreceptor drum 7 is recoated, the electrostatic charger 8 is cleaned, and any degraded component is changed. The renovated drum cartridge 21 is sold at the same price as a brand-new product. In a recycle process of drum cartridge 21 for changing a damaged component, the surface of photoreceptor drum 7 included in the drum cartridge 21 is recoated depending on the number of rotations having been made, the electrostatic charger 8 is cleaned, and any degraded component is changed, besides changing of the damaged component.

When, for example, the damaged component is changed, the number of rotations of photoreceptor drum 7 (e.g. 1K times) may be far short of the end of its life (e.g. 10K times). In such a case, the components including the photoreceptor drum 7 other than the damaged component are used as they are. When the photoreceptor drum 7 has been rotated a considerable number of times (e.g. 9K times) before the operation for changing the damaged component, the drum cartridge 21 is sold as a new product after necessary renovating operations such as recoating of the surface of photoreceptor drum 7 and cleaning of the electrostatic charger 8.

Thus, it is necessary in performing the recycle process of drum cartridge 21 to refer to the number of rotations of photoreceptor drum 7 included in the drum cartridge 21. For this purpose, the drum cartridge 21 includes a memory 22 for storing the number of rotations of photoreceptor drum 7 as historical data. A nonvolatile memory such as an EPROM or flash memory is used as the memory 22 since the drum cartridge 21 has no power source.

Figure 3:
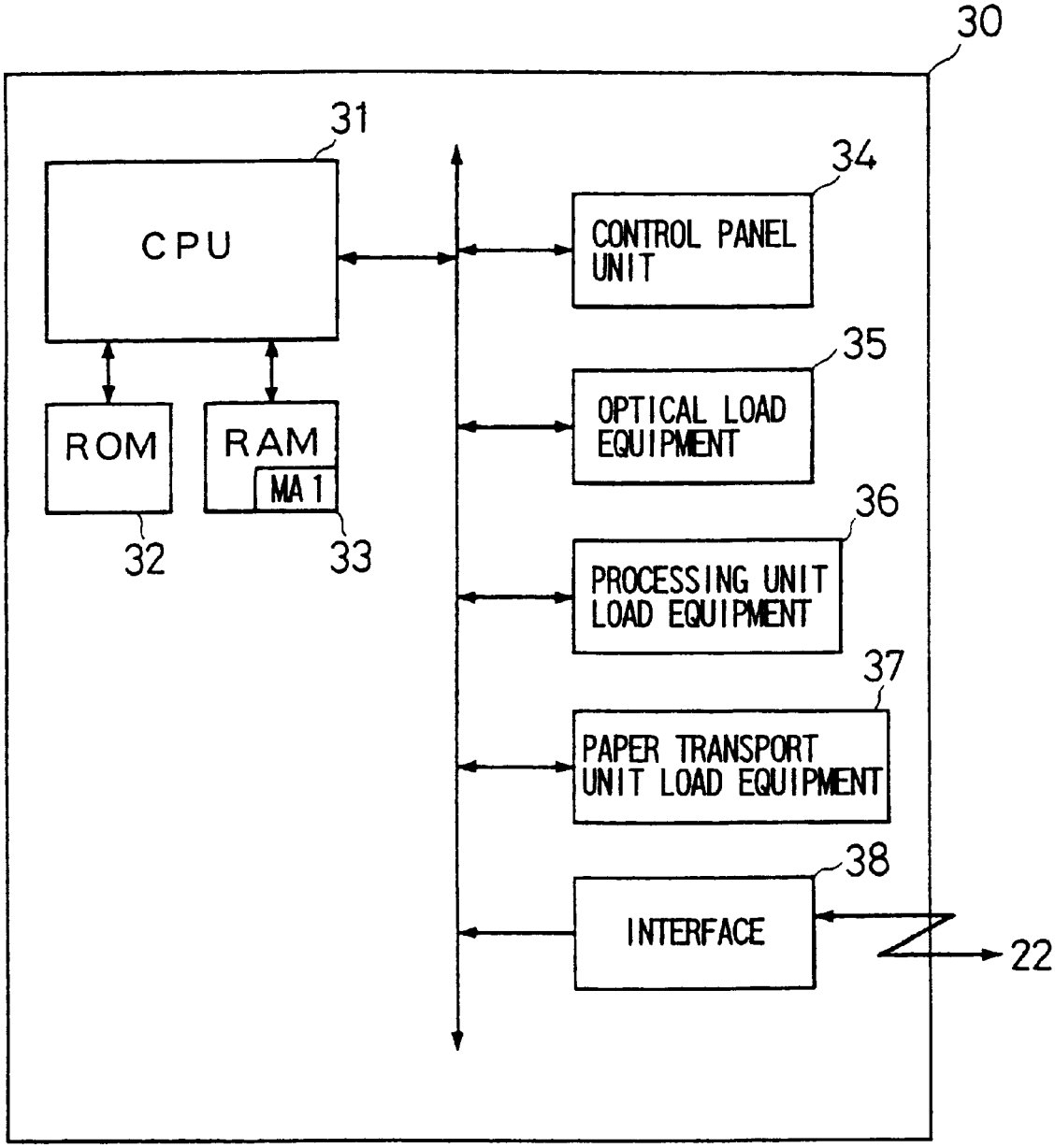
FIG. 3 is a block diagram of a controller of the copying machine.

FIG. 3 is a block diagram showing the construction of a controller of the above copying machine. The controller 30 of copying machine 1 includes a CPU 31 having a ROM 32 and a RAM 33. Connected to the CPU 31 are a control panel unit 34, optical load equipment 35, processing unit load equipment 36, paper transport unit load equipment 37 and an interface 38. The control panel unit 34 includes a display and key switches arranged on an upper surface of a main body of copying machine 1 for displaying data outputted from CPU 31 and inputting control data from the key switches to CPU 31.

The optical load equipment 35 includes the light source 3, a motor for reciprocating the light source 3 and mirrors 4 under the original table 2, and a clutch. The processing unit load equipment 36 includes a high-voltage power source for supplying a high voltage to the electrostatic charger 8 and transfer charger 10, and a motor and the like for rotating the photoreceptor drum 7. The paper transport unit load equipment 37 includes clutches and solenoids for selectively rotating feed rollers, transport rollers and conveyor belts forming the paper transport path 18.

The interface 38 is connected to the memory 22 of drum cartridge 21, and corresponds to the historical data reader of the present invention. CPU 31 communicates data with the memory 22 through the interface 38. That is, CPU 31 at least reads, from the memory 22 through the interface 38, the number of rotations of photoreceptor drum 7 included in the drum cartridge 21 newly installed in the copying machine 1.

CPU 31 performs a comprehensive control of the above input/output equipment according to a program previously written in the ROM 32. In this control, data inputted and outputted are temporarily stored in predetermined memory areas of RAM 33. ROM 32 stores, as the program for controlling the input/output equipment, a program relating to a process control for setting a control condition for image formation, for example. Based on the program relating to the process control, CPU 31 controls the high-voltage power source included in the processing unit load equipment 36 for applying a voltage to the electrostatic charger 8.

Figure 5:
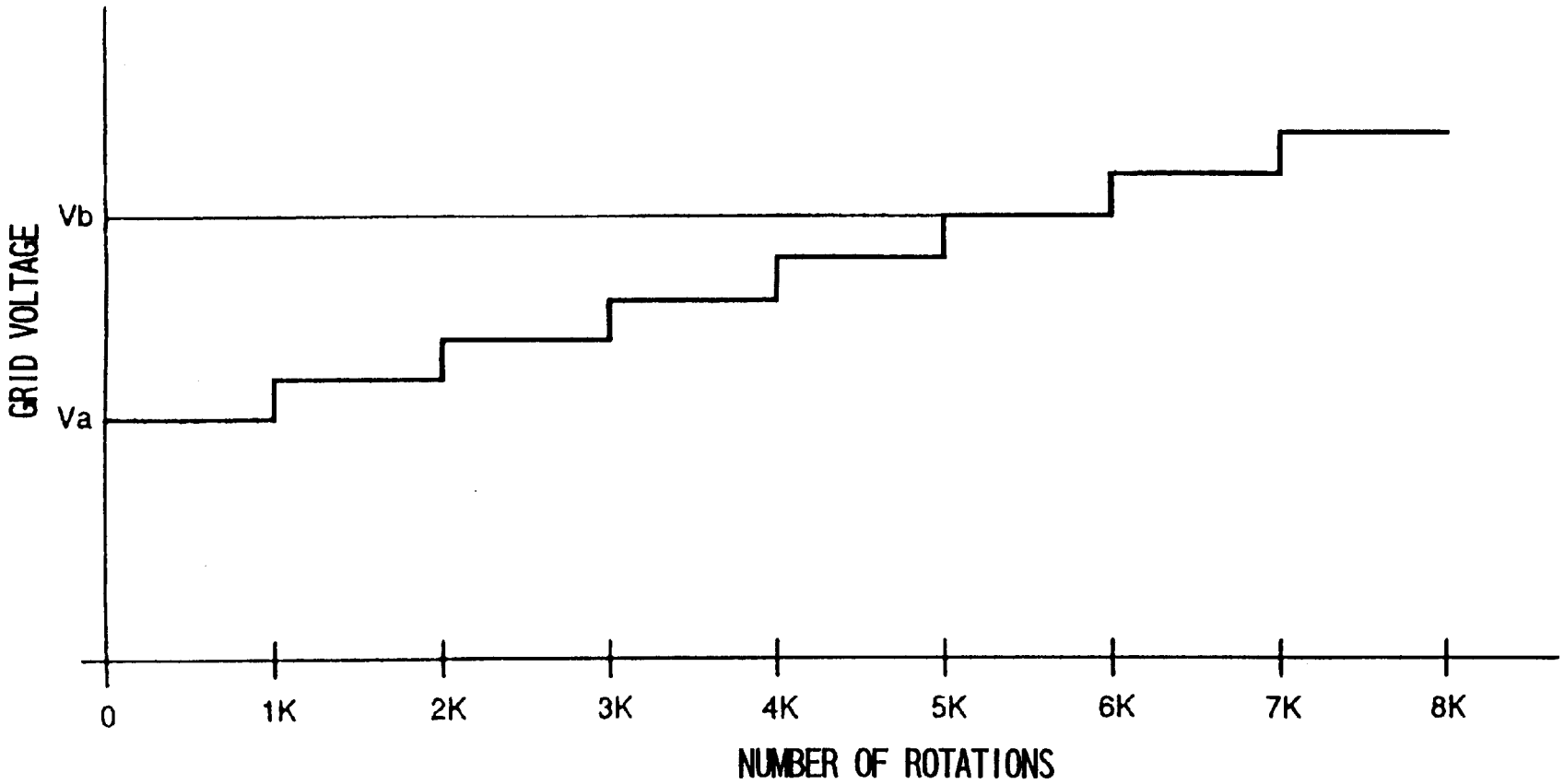
FIG. 5 is a view showing a relationship between the number of rotations of a photoreceptor drum and grid voltage of an electrostatic charger of the copying machine.

That is, as the coating on the surface of photoreceptor drum 7 wears with a cumulative number of rotations of photoreceptor drum 7, the charge potential on the surface of photoreceptor drum 7 lowers and so does image density. Then, in the process control, CPU 31 gradually increases the grid voltage of electrostatic charger 8 according to the number of rotations of photoreceptor drum 7, to thereby compensate for the decrease in the charge potential on the surface of photoreceptor drum 7 due to the cumulative number of rotations, and maintain a proper image density. For this purpose, ROM 32 stores a relationship between the number of rotations of photoreceptor drum 7 and the grid voltage of electrostatic charger 8 as shown in FIG. 5.

As noted above, the drum cartridge 21 collected from the copying machine 1 and having undergone a recycle process does not necessarily include a new photoreceptor drum 7. Thus, when a new drum cartridge 21 is installed in the copying machine 1, a control condition such as the grid voltage of electrostatic charger 8 must be set with reference to the number of rotations of photoreceptor drum 7 included in the drum cartridge 21.

Figure 4:
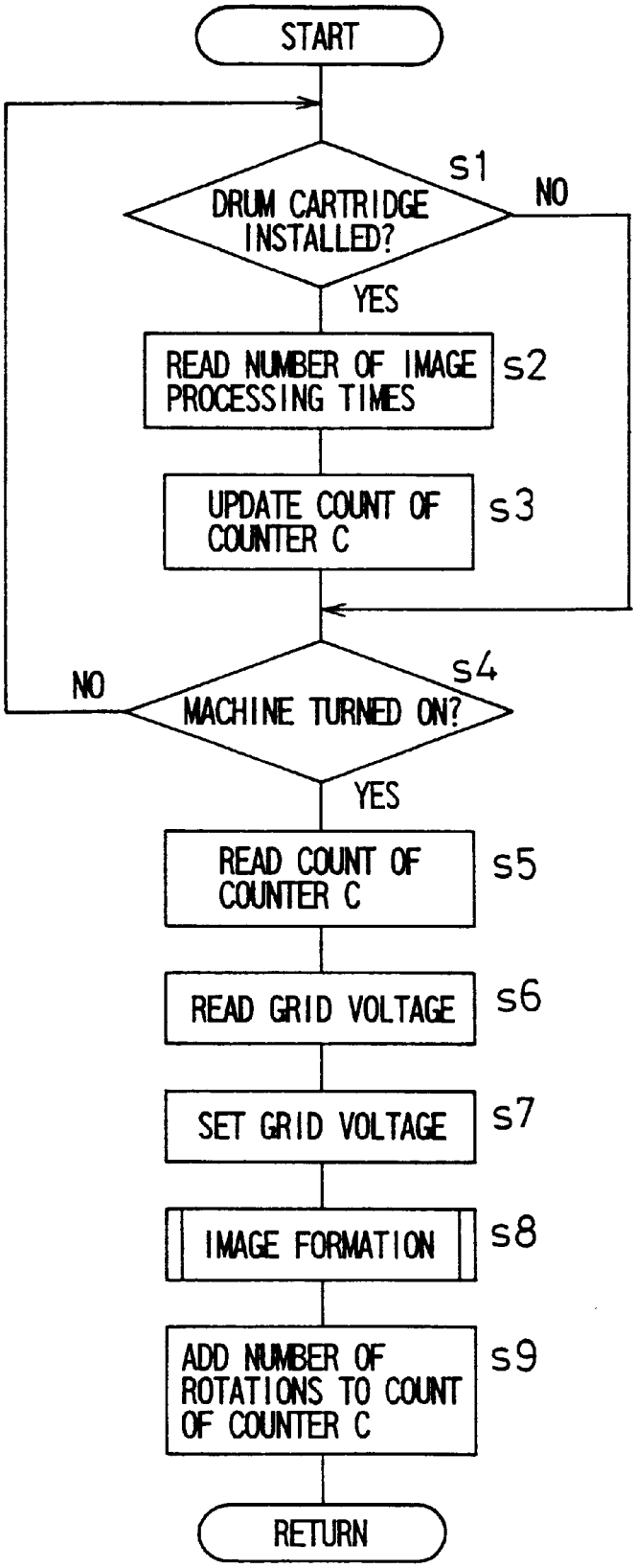
FIG. 4 is a flow chart showing part of a processing sequence of the controller of the copying machine.

FIG. 4 is a flow chart showing part of a processing sequence of the controller of the above copying machine. After the copying machine 1 is switched on, CPU 31 stands by until a copy switch on the control panel is pressed. Meanwhile, CPU 31 determines whether a new drum cartridge 21 is installed or not (s1). When a new drum cartridge 21 is installed in the copying machine 1, CPU 31 reads the number of rotations of photoreceptor drum 7 from the memory 22 of drum cartridge 21 (s2). A count of a counter C allocated to a memory area MA1 of RAM 33 is updated with the number of rotations read (s3). The counter C counts a cumulative number of rotations of photoreceptor drum 7 to be referred to in the process control for controlling the grid voltage of electrostatic charger 8.

When the copy switch is pressed (s4), CPU 31 reads the count of counter C (s5), and derives a grid voltage corresponding to the count read, from the relationship between the number of rotations of photoreceptor drum 7 and grid voltage of electrostatic charger 8 pre-stored in the ROM 32

(s6). The grid voltage derived is set to the high-voltage power source included in the processing unit load equipment 36 (s7). In this state, CPU 31 carries out an image forming operation by controlling each load equipment (s8). CPU 31 adds the number of rotations of photoreceptor drum 7 made during the current image forming operation to the count of counter C (S9), and returns to the state of standby to wait for an operation of the copy switch.

In the above process, the copying machine 1 in this embodiment performs the process control for an image forming operation using the newly installed drum cartridge 21, with reference to the number of rotations of photoreceptor drum 7 stored in the memory 22 of drum cartridge 21. Where the process control is executed based on the relationship between the number of rotations of photoreceptor drum 7 and grid voltage of electrostatic charger 8 shown in FIG. 5, grid voltage Va is set first when, for example, the drum cartridge 21 accommodating a new photoreceptor drum 7 is installed, and grid voltage Vb is set first when the drum cartridge 21 accommodating a photoreceptor drum 7 having the number of rotations at 5K is installed.

Thus, a control condition corresponding to the number of rotations of photoreceptor drum 7 included in the drum cartridge 21 installed in the copying machine 1 may be set even when the photoreceptor drum 7 has an indefinite number of rotations. The copying machine 1 may be maintained in an excellent image forming state even when the drum cartridge 21 is recycled for use after being collected from the copying machine 1 as a result of the photoreceptor drum 7 coming to the end of its life or damage being done to any component.

As a method of storing the number of rotations of photoreceptor drum 7 in the memory 22 of drum cartridge 21, processes may be carried out for causing the CPU 31 to write a count of counter C through the interface 38 each time the copying machine 1 is turned off, and to rewrite data stored in the memory 22 when the drum cartridge 21 is recycled, according to what is done in the recycle process.

In the copying machine 1 in this embodiment, the number of rotations of photoreceptor drum 7 is read from the memory 22 of drum cartridge 21. Alternatively, the drum cartridge 21 may include an indicator for indicating the number of rotations of photoreceptor drum 7, the number of rotations of photoreceptor drum 7 being read from the indicator. The indicator may be in the form of a seal having a sign, numerals or a bar code representing the number of rotations, or a movable member showing the number of rotations by position or arrangement. When removing the drum cartridge 21 from the copying machine 1, a serviceman may read the number of rotations of photoreceptor drum 7 from the copying machine 1, and apply a seal having the number of rotations read, or move the movable member to a position corresponding to a number of rotations read. In this case, the historical data reader may be an optical or contact sensor suited to the indicator, instead of the interface 38 shown in FIG. 3.

Further, in the copying machine 1 in this embodiment, as a control condition in forming an image, the process control is carried out to control setting of the grid voltage of the electrostatic charger 8. It is also possible to control the developing bias or light source voltage instead of or in addition to the grid voltage of the electrostatic charger 8.

FIG. 6 is a flow chart showing part of a processing sequence of the controller of the copying machine in one embodiment of the invention. When a serviceman key-inputs through the control panel an operation for removing the drum cartridge 21 or when a sensor disposed in a mounting position of drum cartridge 21 detects removal of drum cartridge 21 (s11), CPU 31 reads the count indicating the number of rotations of photoreceptor drum 7 from the counter C allocated to the memory area MA1 of RAM 33 (s12). The count read is written in the memory 22 of drum cartridge 21 (s13).

In this process, the number of rotations of photoreceptor drum 7 is written in the memory 22 when the drum cartridge 21 is removed from the copying machine 1 for a recycle process. With reference to the number of rotations written in the memory 22 in time of recycling the drum cartridge 21, a recycle process may be performed for the drum cartridge 21 in a way suited to the use state thereof.

Where an indicator such as a seal is used in place of the memory 22, image data of the count of counter C corresponding to the number of rotations read from RAM 33 may be prepared by the image writing device 1*a*. The photoreceptor drum 7 is irradiated with laser beams based on this image data to effect image formation. The image representing the number of rotations is printed on a seal or the like inserted by a serviceman. The serviceman applies the seal to the drum cartridge 21 removed from the copying machine 1. Particulars of a recycle process may be determined each time of recycling with reference to the number of rotations printed on the seal applied to the drum cartridge 21.

As shown in FIG. 7A, the seal may give maintenance data including particulars of a change made previously, as well as the number of rotations (number of copies) given as historical data. Alternatively, the seal may give historical data in the form of a bar code as shown in FIG. 7B. Where seals as shown in FIG. 7A are applied to individual drum cartridges 21, an operator may be able to classify the drum cartridges 21 according to the process to be carried out, by reading before a recycle process what is indicated on the seals. Where seals as shown in FIG. 7B are applied to individual drum cartridges 21, the drum cartridges 21 may be classified automatically according to the process to be carried out, by reading with a bar-code reader before a recycle process what is indicated on the seals.

Figure 8:
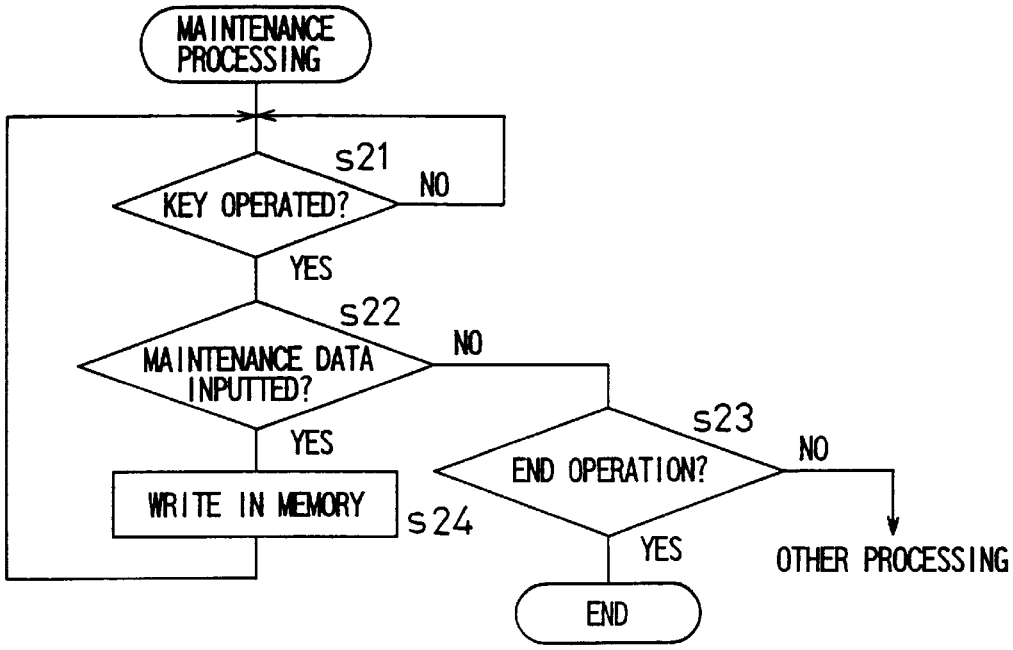
FIG. 8 is a flow chart showing part of a processing sequence of the controller of the copying machine in another embodiment of the invention.

FIG. 8 is a flow chart showing part of a processing sequence of the controller of the copying machine in another embodiment of the invention. During maintenance of the copying machine 1 by a serviceman, CPU 31 stands by until keys on the control panel are operated. When the serviceman operates the keys (s21), CPU 31 determines what operations should be carried out. If the serviceman inputs maintenance data (s22), CPU 31 writes the inputted maintenance data in the memory 22 of drum cartridge 21 (s24). CPU 31 ends the maintenance operation when the serviceman inputs an end of the maintenance operation (s23).

The maintenance data inputted through the key operation by the serviceman is indicative of a state of image formation such as a deformation of drum cartridge 21, damage or depletion of components, or fogging. This maintenance data is stored in the memory 22 of drum cartridge 21 as part of the historical data to be referred to when recycling the drum cartridge 21. Thus, by referring to the data stored in the memory 22 when recycling the drum cartridge 21, a recycle process suited to the state of use may be effected accurately for that drum cartridge 21.

The maintenance data inputted by the serviceman during maintenance not involving change of drum cartridge 21 may be stored in RAM 33. The maintenance data stored in RAM 33 may be written in the memory 22 of drum cartridge 21 when the drum cartridge 21 is removed from the copying machine 1.

Figure 9:
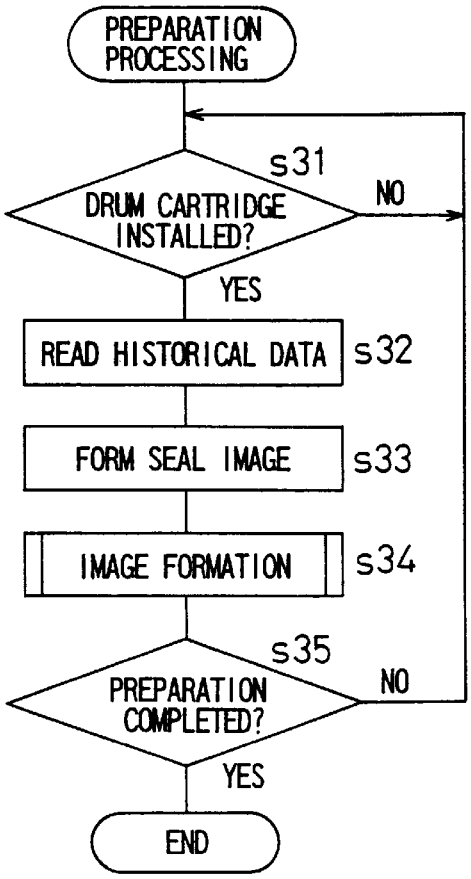
FIG. 9 is a flow chart showing part of a processing sequence of the controller of the copying machine in still another embodiment of the invention.

FIG. 9 is a flow chart showing part of a processing sequence of the controller of the copying machine in still another embodiment of the invention. CPU 31 executes the preparatory processing mode in preparation for the recycle process in response to a particular key operation. In this preparatory processing mode, CPU 31 stands by until the drum cartridge 21 is installed in the copying machine 1. When the drum cartridge 21 is installed in the copying machine 1 (s31), CPU 31 reads historical data from the memory 22 (s32). Based on the historical data read from the memory 22, CPU 31 prepares image data to be printed on the seal shown in FIG. 7A or 7B (s33), and carries out an image forming process based on the image data prepared (s34). CPU 31 repeatedly executes steps s31 through s34 in the preparatory processing mode.

Through the above processing, the copying machine 1 having the drum cartridge 21 to be recycled may be used to prepare a seal with historical data printed thereon which is to be referred to in classifying the drum cartridge 21 according to the recycle process to be carried out. When the drum cartridge 21 with the memory 22 storing the historical data is collected, the historical data may be read with ease for easily and accurately performing an operation to classify the drum cartridge 21 according to the particulars of the recycle process before a recycling operation.

Figure 10:
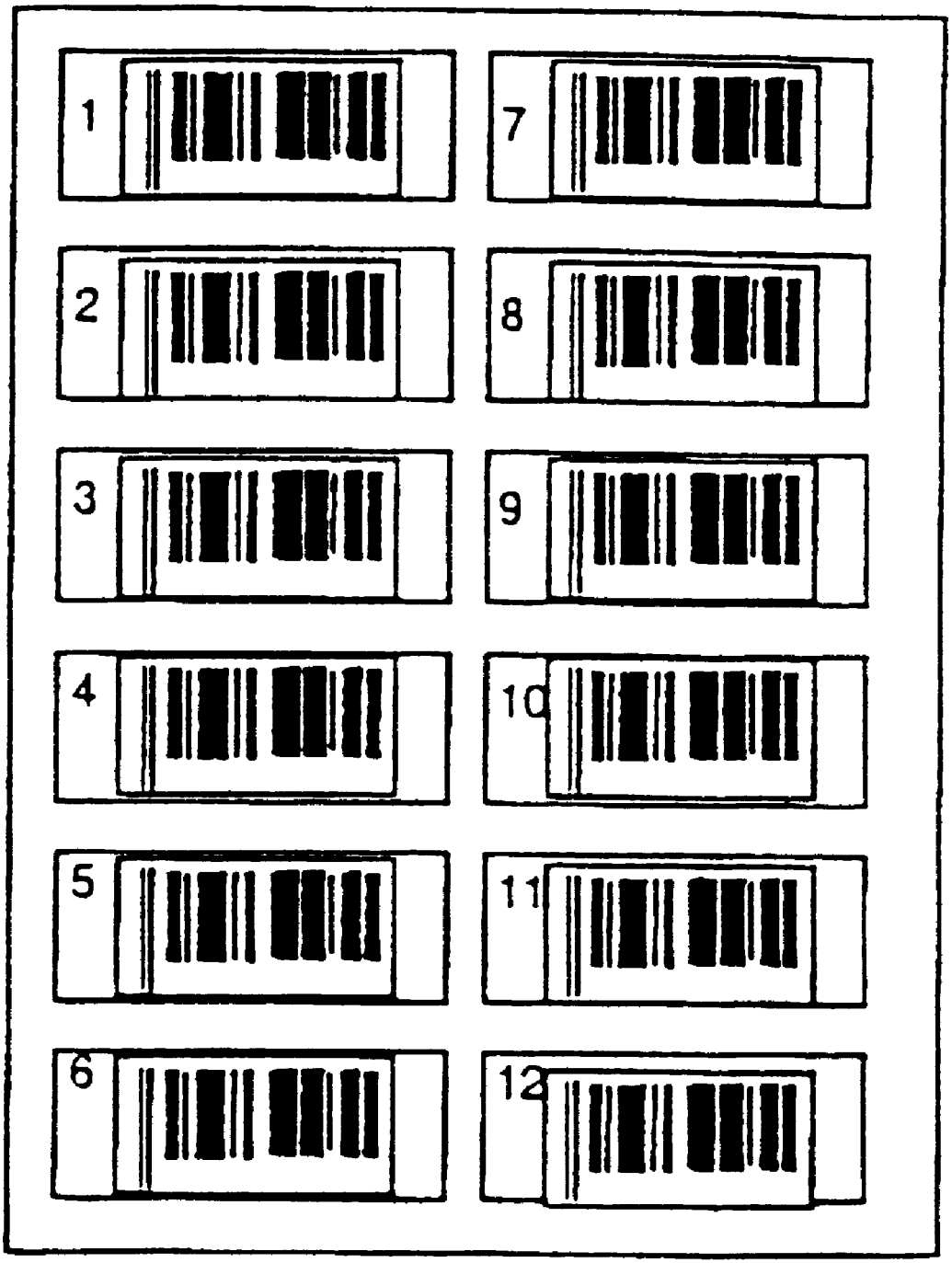
FIG. 10 is a view showing seals printed and outputted by the copying machine.

After steps s31 through s33 are repeated a predetermined number of times, step s34 may be executed to print, on a single sheet as shown in FIG. 10, seals to be applied to a predetermined number of drum cartridges 21. In this case, numbers may be affixed to the seals to clarify the correspondence between the seals and drum cartridges 21.

In the preparatory processing mode, as shown in FIG. 11A or 11B, information including a work procedure of the recycle process corresponding to the historical data may be printed on the seal, to allow the operator to easily determine the particulars of the recycle process to be carried out for each drum cartridge 21. In this way, the recycle process may be carried out accurately even if the operator lacks experience.

Further, it is possible to use a recycle processing apparatus exclusive to the preparatory processing mode. In this case, the recycle processing apparatus may include a mount for receiving the drum cartridge 21, a reading device for reading historical data from the memory 22 of drum cartridge 21, and a printing device for printing the historical data read from the memory 22 on a seal.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus having a recyclable image forming unit removably mounted therein and including visible information relating to image forming unit continuous historical data, the image forming apparatus comprising:

a historical data reader that reads the visible information relating, to image forming unit historical data; and a controller communicating with the historical data reader, the controller setting a control condition for image formation based on the historical data read by the historical data reader.

2. The image forming apparatus of claim 1, wherein historical data is outputted when the image forming unit is removed from the image forming apparatus for recycling of the image forming unit.

3. The image forming apparatus of claim 2, further comprising an input device for accepting an input of the historical data.

4. The image foiming apparatus of claim 1, wherein the image forming unit includes a photoreceptor drum, and wherein the continuous historical data includes a cumulative number of rotations of the photoreceptor drum.

5. The image foiming apparatus of claim 1, wherein the controller controls a voltage applied to the photoreceptor drum so that the voltage is stepwise increased as the cumulative number of rotations of the photoreceptor drum increases.

6. A recycle processing apparatus for recycling an image forming unit, the recycle processing apparatus comprising:

a mount that receives the image forming unit to be recycled;

a historical data reader that reads continuous historical data of the image forming unit; and an output device communicating with the historical data reader, the output device outputting, as visible information, the historical data read by the historical data reader, wherein the output device includes structure for effecting classification of the image forming unit for the recycle process.

7. The recycle processing apparatus of claim 6, wherein the output device outputs particulars of a recycle process according to the historical data as visible information.

* * * * *